US006299076B1

(12) United States Patent
Sloan et al.

(10) Patent No.: US 6,299,076 B1
(45) Date of Patent: Oct. 9, 2001

(54) STEAM CLEANING SYSTEM

(76) Inventors: Jeffrey E. Sloan, 3827 Palo Dr., Bonita, CA (US) 91902; Eugene L. Bellegarde, 4168 Lodi Way, San Diego, CA (US) 92117

( * ) Notice: Subject to any disclaimer, the term of this patent is extended or adjusted under 35 U.S.C. 154(b) by 0 days.

(21) Appl. No.: 09/523,069

(22) Filed: Mar. 10, 2000

(51) Int. Cl.[7] ..... B05B 1/24

(52) U.S. Cl. ..... 239/136; 239/135; 392/396; 392/399; 122/40

(58) Field of Search ..... 239/135, 136; 392/324, 386, 394, 396, 397, 398, 399; 122/4 A, 40, 13.2, 134, 459, 460, 461, 466, 470, 471, 472–476

(56) References Cited

U.S. PATENT DOCUMENTS

| | | | | |
|---|---|---|---|---|
| 2,548,081 | * | 4/1951 | Touloukian | 122/40 |
| 2,790,428 | * | 4/1957 | Buttler | 122/134 |
| 3,410,986 | * | 11/1968 | Groom | 392/399 |
| 3,781,518 | | 12/1973 | Power et al. . | |
| 4,349,723 | | 9/1982 | Swiatorz . | |
| 4,414,037 | | 11/1983 | Friedham . | |
| 4,572,943 | | 2/1986 | Hogfeldt . | |
| 4,724,824 | | 2/1988 | McCoy et al. . | |
| 4,764,660 | | 8/1988 | Swiatoz . | |
| 4,818,843 | | 4/1989 | Swiatoz . | |
| 4,857,703 | | 8/1989 | Wilkins . | |
| 4,878,458 | * | 11/1989 | Nelson | 122/4 A |
| 5,038,742 | | 8/1991 | Uddin . | |
| 5,113,478 | | 5/1992 | Nahashima et al. . | |
| 5,117,482 | | 5/1992 | Hauber . | |
| 5,220,637 | | 6/1993 | Levin et al. . | |
| 5,224,202 | | 6/1993 | Arnold et al. . | |
| 5,249,624 | | 10/1993 | Pow et al. . | |
| 5,355,456 | | 10/1994 | Osofsky . | |
| 5,361,800 | | 11/1994 | Ewing . | |
| 5,372,754 | | 12/1994 | Ono . | |
| 5,400,969 | | 3/1995 | Keene . | |
| 5,421,895 | | 6/1995 | Tsubouchi et al. . | |
| 5,471,556 | | 11/1995 | Friedheim . | |
| 5,693,267 | | 12/1997 | Beshore et al. . | |
| 5,835,667 | | 11/1998 | Li et al. . | |
| 5,862,605 | | 1/1999 | Horie et al. . | |

OTHER PUBLICATIONS

"Leidenfrost Temperature—It's Correlation for Liquid Metals, Cryogens, Hydrocarbons and Water" Baumeister/Simon May 1973 Journal of Heat Transfer.

"On the Effect of Surface Roughness on the Vapor Flow Under Laidenfrost–Levitatatech Droplets" Prat/Schmitz Jun. 1995 vol. 117 Journal of Fluids Engineering.

"On the Collision of a Droplet with a Solid Surface" Chandrat/Avedisian Proc. R. Soc. Lond. 1991.

* cited by examiner

*Primary Examiner*—David A. Scherbel
*Assistant Examiner*—Dinh Q. Nguyen
(74) *Attorney, Agent, or Firm*—Joseph F. McLellan

(57) ABSTRACT

A steam cleaning system for ridding a workpiece of contaminants by directing a jet of steam onto the workpiece. The system includes a steam generator characterized by a central cavity having walls for containing water fed into it from a water inlet conduit. The steam generator includes a heating element for heating the cavity walls to vaporize water located in proximity to the walls. At least a portion of the cavity walls are provided with a thin porous layer of non-corrodible material to form a surface substantially free of major surface irregularities. The porous layer promotes water vaporization, flashing it into steam. Steam formed in the cavity may be superheated for discharge onto the workpiece through an external nozzle. The system components, including the water pump, are made of non-corrodible, preferably non-lubricated materials to prevent contamination of the workpiece and increase the service life of the pump.

14 Claims, 1 Drawing Sheet

STEAM CLEANING SYSTEM

BACKGROUND OF THE INVENTION

Field of the Invention

The present invention relates to cleaning systems in which a jet of heated steam is directed onto a workpiece to remove contaminants.

DESCRIPTION OF THE PRIOR ART

It is known to direct steam onto a workpiece to rid it of contaminants. In certain systems of the prior art the steam is developed by pumping water into the internal cavity of a "steam pot" or generator. An integral heater raises the temperature of the cavity walls and the resultant heat transfer raises the water temperature to a critical point characterized by conversion or "flashing" of the water into steam.

The flashing of water into steam is adversely affected by a phenomenon known as the Leidenfrost effect, in which water globules or droplets dance or skitter across the hot cavity walls. The lack of sufficient contact between the levitated water droplets and the heated surfaces reduces thermal conduction of heat to the water.

Empirical studies show that the heating of a droplet of water to a certain temperature develops an insulating vapor layer under the droplet after it impacts with the heated surface. This forms a vapor layer or pressure field at the bottom of each droplet. The pressure between the droplet and the heated source builds to the point that the droplet moves away from, or is levitated above the heated surface, i.e. the weight of each droplet is buoyed by the pressure field beneath the droplet. This results in only intermittent contact of the droplet with the heated surface and delays complete vaporization of the droplet.

Certain prior art studies investigated the effect of cavity surface roughness on the fluid dynamics of the vapor layer under the levitated droplets. One such study was directed to surface roughness characterized by prominent rectangular, semi-cylindrical or triangular surface irregularities. The study suggested that impingement of the droplets against such irregularities reduced the thickness or rate of flow of the vapor layer, and thereby promoted more continuous contact between the water droplets and the cavity walls.

For example, U.S. Pat. Nos. 4,414,037 and 5,471,556 teach the formation of irregular surfaces by etching or grooving of the cavity surfaces. This was apparently intended to enhance collision of the water droplets with such surfaces to enhance their flashing into steam. The '037 patent describes such surfaces as non-uniform internal surfaces formed by overnight chemical etching as deep as possible, in the order of 1/32 inch to 1/8 inch. The '556 patent describes the surfaces as having a plurality of ridges and grooves, the height and depth of which vary substantially randomly, and a typical depth in the order of 0.030 inch to 0.050 inch.

Prior art Pat. Nos. 2,652,645; 3,218,141; and 3,721,802 also teach container flashing surfaces with rough or irregular features.

However, the formation of cavity wall surfaces into randomly configured surface irregularities is time consuming, technically demanding and yields randomly variable results. In contrast, the present invention does not adopt prior art techniques that involve impingement of the water droplets against irregular cavity wall surfaces. Instead, there is impingement against relatively smooth or uniform surfaces formed of material having interconnecting pores or passageways. These are operative to carry away vapor and thereby reduce the thickness of the vapor layer under the droplets.

SUMMARY OF THE INVENTION

The cavity walls are typically made of relatively high heat conduction material such as an aluminum alloy which is machined or otherwise fabricated to provide surfaces adapted to accept a coating or layer of porous non-corrodible material such as stainless steel.

Although all of the wall surfaces of the cavity can be coated, coating only the lower half of the cavity has been found to provide good results.

The coating is preferably very thin and made of stainless steel, although other materials can be used if desired for particular applications.

It is theorized that the small interconnecting pores which characterize the porous coating serve as escape passages for the heated vapor which is generated beneath the water droplets when they impinge upon the heated surfaces within the cavity. The heated water droplets are apparently levitated or supported by the heated vapor layer. With the pores serving as escape passages for this vapor layer, the thickness or pressure of the layer supporting the water droplets is reduced and the droplets then move into closer thermal relationship with the heated cavity walls. This greatly improves the conversion or flashing of water droplets into steam compared to the systems of the prior art.

DESCRIPTION OF THE PREFERRED EMBODIMENT

Figure 1:
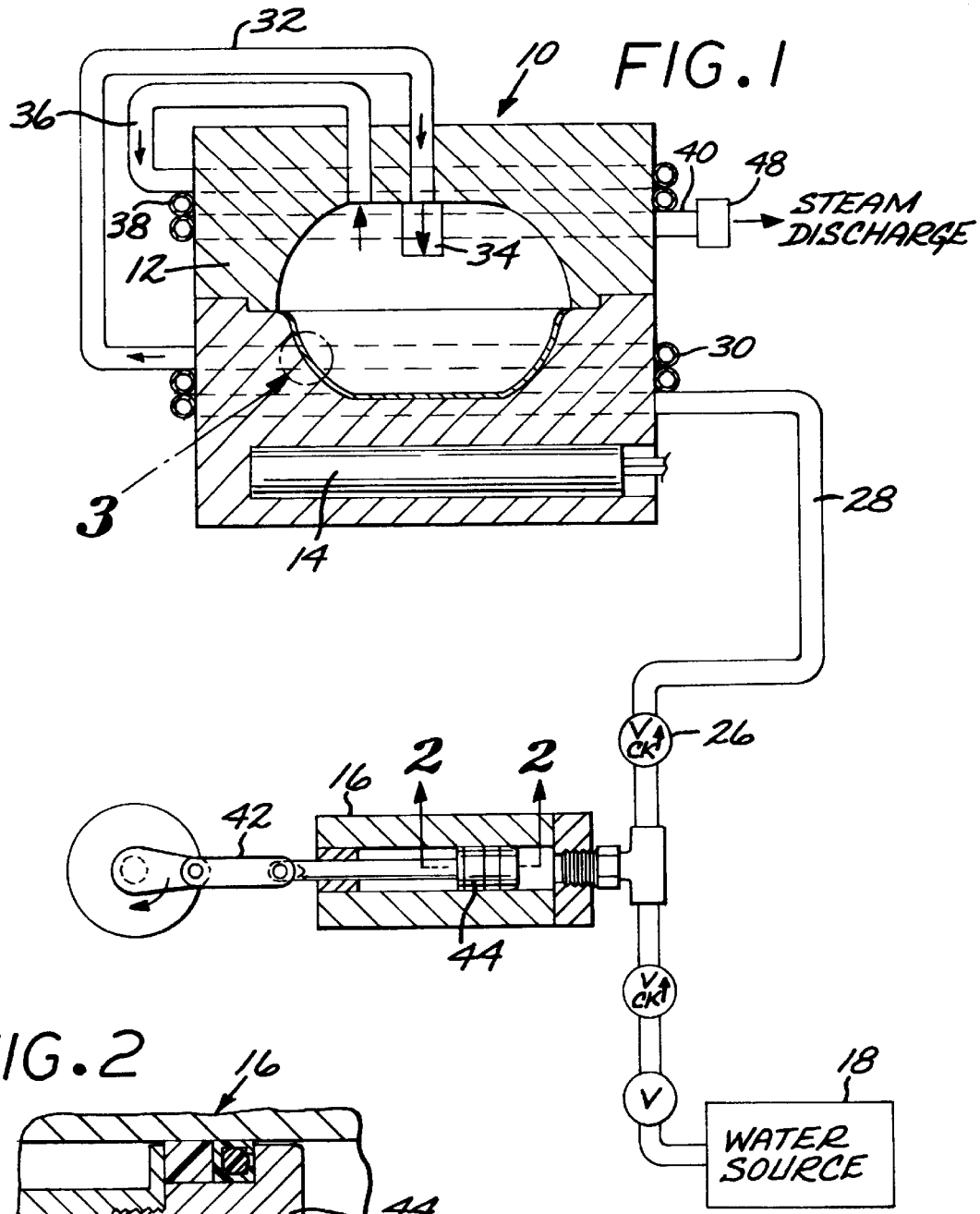
FIG. 1 is a transverse cross sectional, partially diagrammatic view of the steam generator and its associated components, according to the present invention.
Figure 2:
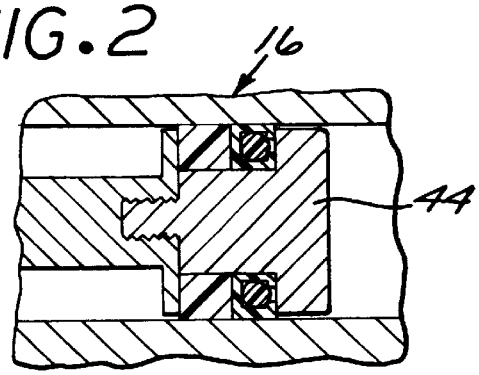
FIG. 2 is an enlarged view taken along the line 2—2 of FIG. 1.
Figure 3:
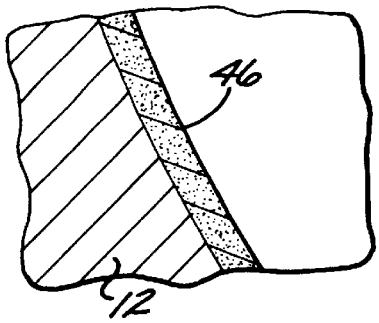
FIG. 3 is an enlarged sectional view taken across a portion of the steam generator cavity walls, as indicated by the numeral 3 in FIG. 1.

Referring now to the drawings, and more particularly to FIG. 1, the pot or steam generator 10 is made in two halves joined by welding or other means, which defines an internal compartment or cavity having walls 12. The halves are preferably made of a high heat conductivity material such as an aluminum alloy, copper, Monel or the like, and the lower half includes one or more integral electric heating elements 14. These raise the temperature of the cavity walls 12 sufficiently to cause conversion or flashing of water in the cavity into steam.

Machining the cavity surfaces until they are smooth makes it easier for such surfaces to be coated or clad. Achieving a smooth layer by casting is also an option. In either case, irregularities are not etched or cut into the surfaces such as would roughen the surfaces and prevent the later formation of a smooth coating on the cavity surfaces. Such a coating is achieved by application of a smooth layer of material 46 which is preferably a stainless steel or other non-corrosive material such as ceramic, nickel, chromium, titanium or the like.

The surface of the stainless steel layer 46 is smooth and uniform, and preferably quite thin, in the order of 0.003 inches to 0.006 inch. This dimension is merely exemplary and is not intended to limit the scope of the invention.

The layer 46 can be applied by any suitable method which is effective to form the desired thin porous layer upon the aluminum substrate or inner surfaces of the cavity. A flame spray method has been found to be satisfactory in forming the porous layer 46 because it is operative to apply or spatter particles or fragments of the stainless steel onto the cavity surfaces so as to form a smooth surface having pores or passageways in the vicinity of the particles. As previously indicated, it is theorized that these pores carry off or vent a significant amount of the heated vapor which develops between the heated layer 46 and the water droplets that impinge upon the heated layer 46.

As previously indicated, venting of the heated vapor reduces the so-called Leidenfrost effect because it reduces the pressure and thickness of the heated vapor layer so that the water droplets can drop down into closer, more efficient heat transfer proximity to the heated layer 46.

The layer 46 is made relatively thin to compensate for the fact that stainless steel or like materials have only a limited ability to transfer heat to the underlying aluminum cavity walls. The thickness of the layer is preferably between 0.003 and 0.010 inches. These dimensions are given by way of example and are not intended to limit the scope of the invention.

The size of the pores varies according to the particular application and by what is found to be the most effective size to carry away heated vapor from beneath the heat-levitated water droplets.

Any suitable pumping means, such as a conventional reciprocating water pump 16, is used to pump water from a suitable water source 18 into the steam generator cavity. The water is preferably deionized or otherwise filtered or purified. Water flow from the source 18 discharges into a conduit 28 which is in fluid communication with a preheating coil 30 disposed around the steam generator 10 in thermally conductive relation.

The outlet of the coil 30 is connected to a conduit 32 which extends into the cavity. A dispersing nozzle or atomizer 34 is coupled to the coil 30 in the upper half of the steam generator 10. The atomizer 34 greatly enhances steam generation because it disburses the incoming water into small water droplets and directs them onto the heated inner surfaces of the pot 10.

The steam which is generated leaves the steam generator 10 by means of a conduit 36 located in the upper half of the generator 10. The conduit 36 is preferably connected to a post-heating coil 38 that extends around the outside of steam generator 10 in thermally conductive relation to thereby superheat the steam leaving the generator.

Conduit 40 carries the steam to a suitable external nozzle 48 operative to direct a jet of the superheated steam onto a workpiece (not shown). It has been found that such nozzle-directed superheated steam is extremely effective in stripping away any contaminants which may be present on the workpiece.

The reciprocating pump 16 includes a piston 44 which is reciprocated in conventional fashion to provide the desired pumping action, as will be apparent to those skilled in the art. The pump 16 is merely exemplary. Any suitable pumping means known to those skilled in the art may be used.

The action of the piston 44 cyclically draws water into the pump 16 and discharges it into the conduit 28. This water flows into the pre-heating coil 30, the conduit 32, and then the atomizer 34.

The pump components are preferably made of non-corrodible material to reduce or eliminate possible contamination of the pump components, the water, and the steam generated.

The non-corrodible material used for the pump components preferably comprises an inert, low friction, or non-lubricated material such as tetrafluoroethylene (trademarked "Teflon"). This or a like material having a low coefficient of friction does not require any externally supplied lubricant. The material also extends the service life of the pump considerably compared to pumps of the prior art.

As previously indicated, the present invention is completely different from the prior art teachings of forming relatively large surface imperfections in the steam generating surfaces to enhance the volume of steam production.

The present invention does not depend upon the formation of such large surface irregularities whatsoever. Instead, the thin layer of porous material formed upon or applied to the cavity wall surfaces, and particularly the presence of intercommunicating passages or pores in the deposited material, reduces the vapor pressure and allows water droplets to come closer to the heated porous layer. This significantly improves the volume of steam production.

The unique characteristics of the present process adapt it for use in the precision cleaning of workpieces that are sensitive to even very small amounts of hydrocarbon corrosion and particulate contamination. Typical applications include precision optics, semiconductors, semiconductor manufacturing equipment, disk drive manufacture, and medical device manufacture. Other applications will immediately suggest themselves to those skilled in the art.

The present apparatus constitutes a significant improvement over the prior art, as discussed above. Although a preferred embodiment of the invention has been described, it will be apparent to those skilled in the art that variations may be made in the invention without departing from the spirit of the invention or the scope of the appended claims.

What is claimed is:

1. A steam cleaning system for ridding a workpiece of contaminants by directing a jet of steam onto the workpiece, the system comprising:

a steam generator characterized by a central cavity having smooth walls for containing water introduced into the cavity;

heating means in the steam generator for heating the smooth walls of the cavity to heat and vaporize water adjacent to the cavity walls into water droplets; and a smooth, uniformly porous layer of non-corrodible material in heat transfer relation with at least a portion of the smooth walls of the cavity, the pores of the porous layer providing intercommunicating fluid paths enabling the escape of heated vapors formed between the water and the porous layer.

2. A system according to claim 1 wherein the smooth walls of the steam generator are made of high heat conductive material.

3. A system according to claim 2 wherein the high heat conductive material is an aluminum alloy.

4. A system according to claim 1 wherein at least a portion of the smooth cavity walls are machined to eliminate major surface irregularities.

5. A system according to claim 1 and including a water inlet conduit and a spray nozzle carried by the water inlet conduit for introducing water into the cavity.

6. A system according to claim 5 and including a pump connected to the water inlet conduit for introducing water into the cavity through the spray nozzle, the portion of the pump exposed to the water being made of inert materials to prevent corrosion of the pump.

7. A system according to claim 5 and including a preheating coil in heat transfer relation with the steam generator and in fluid communication with the water inlet pump whereby water flowing to the spray nozzle is preheated.

8. A system according to claim 1 wherein the non-corrodible material of the porous layer is porous stainless steel.

9. A system according to claim 1 wherein the non-corrodible material of the porous layer is porous nickel.

10. A system according to claim 1 wherein the thickness of the porous layer is approximately 0.003 inches to 0.006 inches.

11. A steam cleaning system for ridding a workpiece of contaminants by directing a jet of steam onto the workpiece, the system comprising:

a steam generator characterized by a central cavity having smooth walls for containing water introduced into the cavity;

heating means in the steam generator for heating the smooth walls of the cavity to heat and vaporize water adjacent to the cavity walls into water droplets, a smooth, uniformly porous layer of non-corrodible material in heat transfer relation with at least a portion of the smooth walls of the cavity the pores of the porous layer providing intercommunicating fluid paths enabling the escape of heated vapors formed between the water and the porous layer; and an external nozzle for directing a jet of steam onto the workpiece, and further including a post heating coil in heat transfer relation with the steam generator and in fluid communication with the cavity and the external nozzle whereby steam in the cavity is superheated in the post heating coil for discharge from the external nozzle.

12. A steam cleaning system for ridding a workpiece of contaminants by directing a jet of steam onto the workpiece, the system comprising:

a steam generator which includes a central cavity for containing water introduced into the cavity, the cavity having a wall portion which is smooth;

heating means for heating the smooth wall portion to vaporize water located near the wall portion and form water droplets; and a layer of non-corrodible material applied to the wall portion in the form of adjacent fragments forming a smooth, uniform surface with interconnecting passageways between the fragments, the passageways defining paths for the escape of any heated vapor layer located between the water droplets and the smooth heated surface of the layer.

13. A steam cleaning system according to claim 12 wherein the passageways are operative to enable escape sufficient to reduce the thickness of the layer and bring the water droplets closer to the layer.

14. A steam cleaning system according to claim 12 wherein the passageways are operative to enable escape sufficient to reduce the pressure in the layer acting to support the water droplets.

* * * * *